United States Patent [19]

Duncan

[11] Patent Number: 4,942,924

[45] Date of Patent: Jul. 24, 1990

[54] LINER SETTING ASSEMBLY AND METHOD

[76] Inventor: Stewart M. Duncan, Jalan Nimur Raya No. 15, Tanah Kusir, Jakarta, Indonesia

[21] Appl. No.: 310,548

[22] Filed: Feb. 13, 1989

[30] Foreign Application Priority Data

Feb. 12, 1988 [GB] United Kingdom ..... 8803287
Nov. 1, 1988 [GB] United Kingdom ..... 8803287

[51] Int. Cl.[5] ..... E21B 23/00; E21B 33/14

[52] U.S. Cl. ..... 166/290; 166/216; 166/208; 166/382

[58] Field of Search ..... 166/382, 285, 286, 290, 166/216, 217, 210, 381, 208

[56] References Cited

U.S. PATENT DOCUMENTS

| | | | |
|---|---|---|---|
| 2,291,371 | 7/1942 | Buchanan et al. | 166/290 |
| 2,876,844 | 3/1959 | Warner | 166/290 X |
| 3,253,655 | 5/1966 | Brown | 166/290 X |
| 3,934,652 | 1/1976 | Cochran | 166/285 |
| 4,010,804 | 3/1977 | Garcia | 166/382 |
| 4,562,889 | 1/1986 | Braddick | 166/381 |
| 4,678,031 | 7/1987 | Blandford et al. | 166/285 X |
| 4,688,642 | 8/1987 | Baker | 166/382 |

*Primary Examiner*—Stephen J. Novosad
*Attorney, Agent, or Firm*—Weintraub, DuRoss & Brady

[57] ABSTRACT

A liner setting assembly is useful in setting a liner into a casing string secured in a borehole of a well. The liner setting assembly includes a cone and a cage. The cone enables slidably fitting over the liner, the cone having grips with an oblique notched face forming an engaging surface. The cage receives the cone and includes a second set of grips having oblique notched faces. The cone and cage assembly is secured to the casing string by the grips. Since the cone has a sliding fit in relation to the liner, the operator can reciprocate and rotate the liner even after the cage and cone assembly has been securely engaged with the casing string in the borehole, thereby enabling a positive indication of the correct set position prior to the cement bonding of the liner to the wall of the well.

10 Claims, 5 Drawing Sheets

10
11
12
13
16
17
18
19
20
21
22
23
24
25
26
27
28
28 1/2
28 4/5
28 5
28 6
28 3
29
30
31
34
VIII
VIII

LINER SETTING ASSEMBLY AND METHOD

BACKGROUND OF THE INVENTION

1. Field of the Invention

This invention relates to a liner setting assembly for use in setting a liner into an oil well.

2. Background of the Invention

A casing string is made up of sections of pipe threadably fastened together and is used to line an oil well. The casing string is designed before drilling commences, but this is an exacting task and, because of the difficulty of designing, ex situ, a casing precisely in accordance with the requirements of any particular well, most deep wells include one or more liners.

A liner is a casing string which is run into the production area of a well to protect the face of the formation and prevent sand or debris from flowing into the well. A liner is usually hung using a liner hanger set in the lower section of the last casing string in the well.

The predominant reasons for using liners are (1) that the well is to be drilled deeper than originally forecast, or (2) that ground formation pressures higher than originally anticipated are encountered.

A tie back receptacle is used to extend a liner to the well head. It enables a damaged or worn casing above a liner to be repaired and provides an added measure of protection against corrosion or pressure.

An existing liner assembly utilizes a "floating cage" which is provided with four drag springs and which acts as a liner hanger. The cage is provided with four arms each of which has a slip for securing the hanger to the previous casing string. Each slip has serrated edge or grip on the side facing the internal wall of the previous casing string. The other side of the slip is smooth so as to enable the liner to slide relative thereto. The liner has welded to its distal end a frustoconical portion. The liner is inserted into the well using a setting tool and setting string (known in the art) until the hanger starts to take its weight (with the frustoconical portion resting on the slips and urging these into contact with the casing string). The liner is then inserted further until a small proportion (e.g. about 1,500kg) of its weight is carried by the hanger and cement is pumped into the annular gap between the liner and the well via a setting shoe at the lower end of the liner to secure the liner in place. During insertion of the cement, the liner is reciprocated and rotated to aid bonding. At this stage, the hanger is not yet set. The term 'set' used herein indicates that the full weight of the liner has been applied to the hanger. When cementing has been completed, reciprocation and rotation is stopped and the full weight of the liner is allowed to rest on the hanger. Hopefully the hanger is now set. The setting string is now used to apply a setting weight (e.g. 2,500kg) to the liner. The setting tool is then removed.

A problem arises in that there is no guarantee that the hanger is actually correctly set in position. Further, it is not possible to move the liner once the hanger has been set since the need to reciprocate and rotate the liner means that the cement must be introduced around the liner prior to setting the hanger.

SUMMARY OF THE INVENTION

According to the present invention there is provided a liner setting assembly for use in setting a liner into a casing string secured in a borehole. The assembly comprising: a first tubular component for slidably fitting over a liner to be set and having a first plurality of engaging devices on its outer peripheral wall; and a second component adapted to receive the first component and having a second plurality of engaging devices, each engaging device of the second plurality having a first surface configured to engage a corresponding one of the first set of engaging devices and a second surface adapted to engage the casing string, whereby movement of a liner is permitted after the second component has been set in a casing string.

In the following the second component will be referred to as a cage, and the first component will be referred to as a cone (although, at least in the preferred embodiment, it is generally cylindrical rather than truly conical). The cage and cone assembly acts as a liner hanger. The described embodiment makes it possible to reciprocate and rotate a liner even after the hanger has been set.

BRIEF DESCRIPTION OF THE DRAWINGS

For a better understanding of the present invention, and to show how the same may be carried into effect, reference will now be made by the way of example to the accompanying drawings.

DETAILED DESCRIPTION OF THE INVENTION

Figure 1:
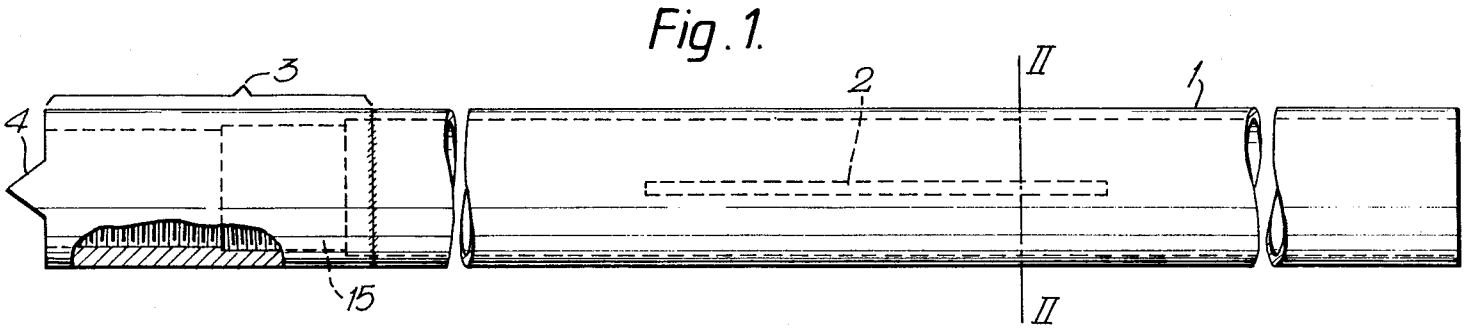
FIG. 1 is a side elevation, partially in section of a setting tool.
Figure 2:
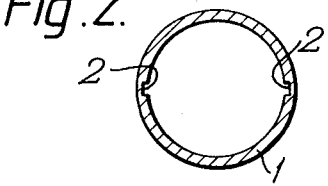
FIG. 2 is a section on line II—II of FIG. 1.
Figure 1A:
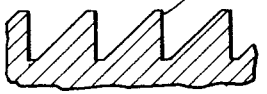
FIG. 1A shows part of a thread of the setting tool.

FIG. 1 depicts a setting tool comprising a tie back receptacle 1 of cylindrical cross-section and dimensions, external diameter 21 cm, internal diameter 17 cm and length 183 cm. As shown in FIG. 2, the tie back receptacle 1 has two diametrically opposed grooves 2, 1.5 cm wide and 61 cm long to accommodate the splines 11 of a running tool 5 described later. One end portion 3 (the left hand end in the Figure) of the receptacle 1 is internally threaded with a left handed thread region, as shown in diagram in FIG. 1A, and a thread region compatible with a liner thread. The receptacle 1 is provided with two diametrically opposed tongues 4 whose purpose will be described hereinafter.

Figure 4:
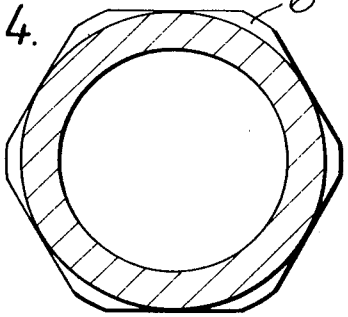
FIG. 4 is an elevation on IV—IV of FIG 3.
Figure 3:
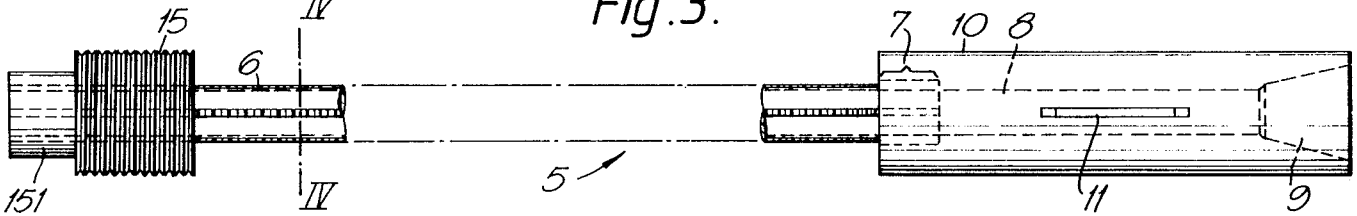
FIG. 3 is a side elevation of a running tool.

The setting tool 1 receives a running tool 5 as shown in FIGS. 3 and 4. The running tool 5 comprises a tubular section 6 and hexagonal outer form having one end 7 secured to a housing 10 of length 61 cm and external maximum dimension 16.5 cm. The housing 10 has a bore 8 along its length which opens into a frustoconical portion 9 length 11.4 cm.

The housing 10 carries two radially outwardly spring loaded splines 11 which cooperate with the grooves 2 in the setting tool 10 of FIG. 1. This feature is shown in more detail in FIG. 5, where springs 12 and the screws 13 hold the spline 11 in place.

The other end of the tubular section 6 carries a nut 15, which is sliding fit on the section 6 and which is externally left handedly threaded to cooperate with the threaded portion 3 of the setting tool 1. The tubular section 6 terminates in a fixed stop 151.

Figures 5, 6, 7, 8:
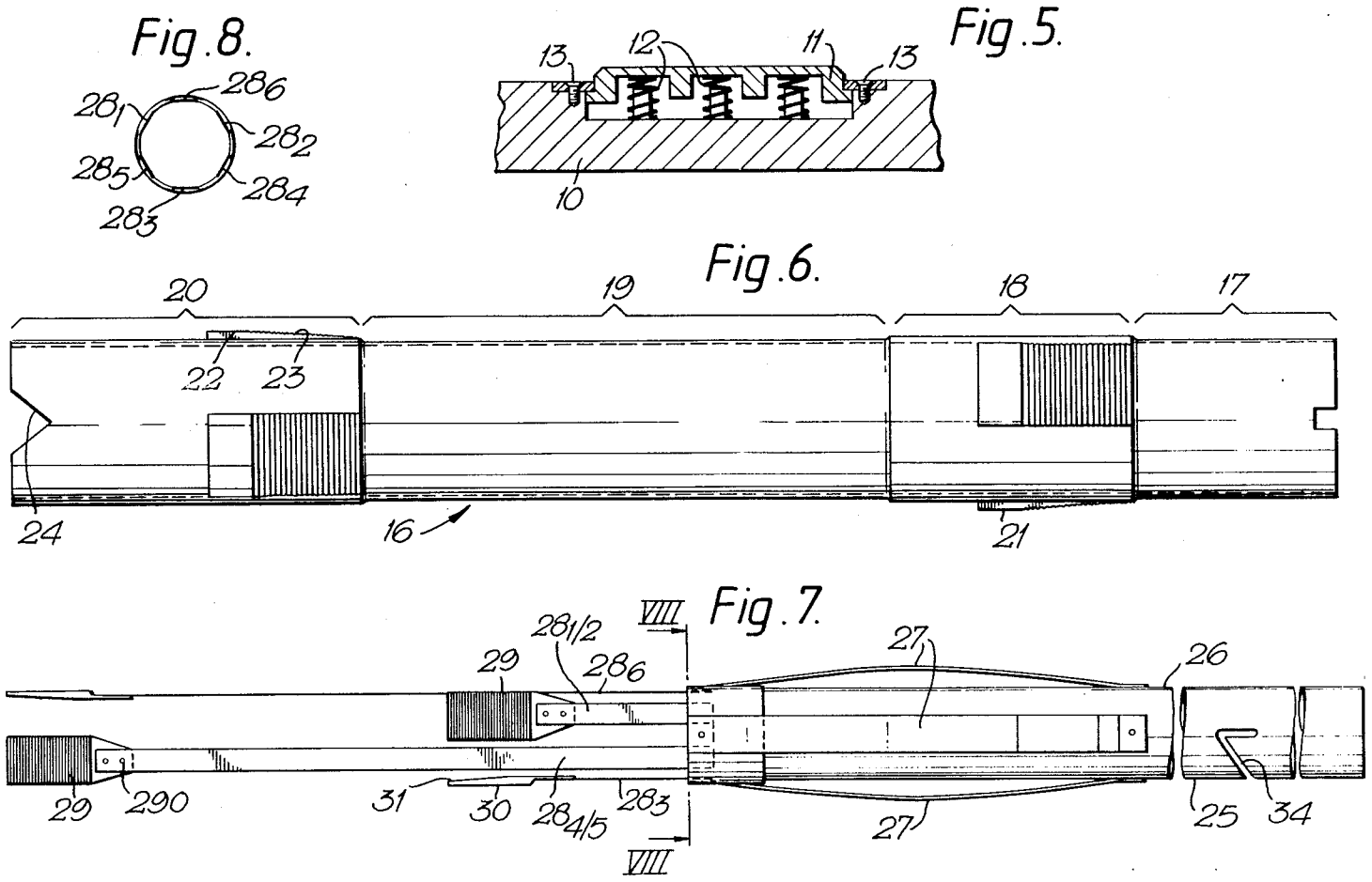
FIG. 5 is a partial section through the housing shown in FIG. 3.
FIG. 6 shows one form of the first component of the setting assembly.
FIG. 7 shows one form of the second component for cooperating with the first component of FIG. 6.
FIG. 8 is a view taken along line VIII—VIII in FIG. 7.

FIGS. 6, 7 and 8 depict first and second components forming a cone and cage assembly for use in setting a liner 37. The cone 16 is a hollow tube 152 cm. in length and has an end portion 17 of external diameter 18.7 cm, an intermediate portion 18 of 19.4 cm external diameter, a central portion 19 of 18.7 cm external diameter and an end portion 20 of 19.4 cm external diameter. The intermediate and end portions 18, 20 each carry three slips or grips 21 equally spaced circumferentially. Each grip 21 has a surface defining a flat head portion 22 and an oblique, notched portion 23 forming an engaging surface. The grips 21 are each 7" in length. The end portion 20 has two diametrically opposed notches 24 which cooperate with the tongues 4 of the tie back receptacle 1 as described later.

A cage 25 for cooperating with the cone 16 is shown in FIG. 7. The cage 25 has a hollow portion 26 of length 91.4 cm and external diameter 18.1 cm which carries four springs 27 equally spaced around its periphery. The springs 27 are 7.6 cm wide and 0.4 cm thick. Secured to the hollow portion 26 are six arms $28_{1-6}$, each arm carrying a respective slip or grip 29. Three of the arms ($28_{2,3}$) are 30.5 cm long forming a first set, while three of the arms ($28_{4,5,6}$) are 122 cm long forming a second set. Each grip 29 is 17.7 cm long and has a flat notched face 30 and an oblique notched face 31, forming respective opposed engaging surfaces. The grips 29 are secured to the arms 28 by Allen screws 290.

In use, the end of the cone 16 abuts one end 32 of the hollow portion 26 of the cage 25 so that the oblique faces 31 of the grips 29 can cooperate with the oblique faces 23 of the grips 21. In this way, a cage and cone assembly is formed.

Figure 9:
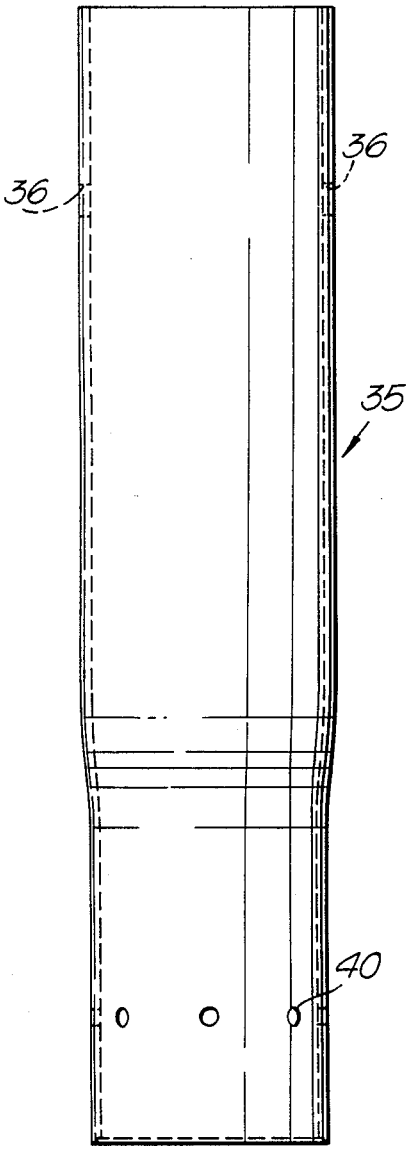
FIG. 9 is a side view of a receptacle for the second component.
Figure 10:
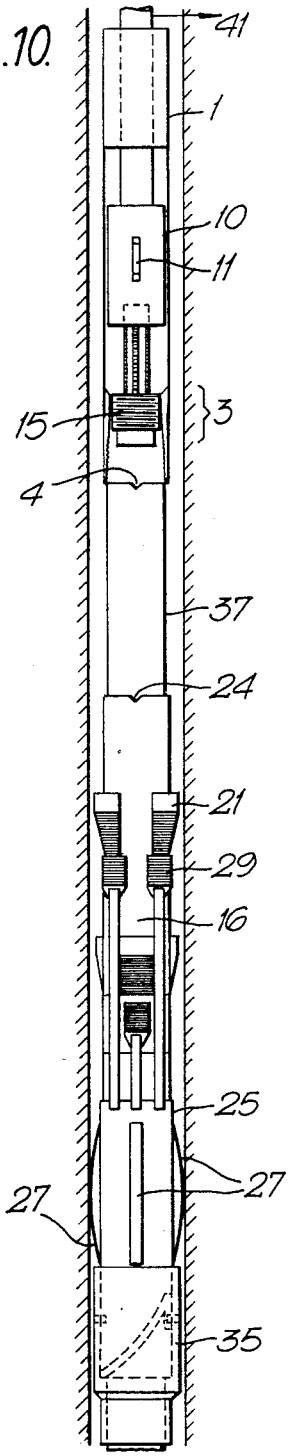
FIG. 10 is a diagrammatic view of the setting assembly in use prior to setting of the hanger.

The cage 16 also has two diametrically opposed right hand J slots 34 which cooperate with a J cage receptacle 35 shown in FIG. 9. The receptacle 35 has two internally projecting lugs 36 for cooperating with the slots 34. The lower end of this J cage receptacle 35 can be secured to the liner 37 by Allen screws 40 or by screw threading (not shown).

As will be made clearer later, the lugs 36 on the J cage receptacle 35 prevent premature setting. Thus, the hanger can only be set when the liner 37 has been withdrawn to the desired setting depth.

During the process described in the following, a weight gauge is used to indicate to the operator the weight of the equipment and the drag loss of the weight in the casing string.

Reference will now be made to FIGS. 10–14 to describe the steps of the method of operation of the liner setting assembly.

(1) Prior to inserting a liner 37 to be set into the well, a set shoe 38 (FIG. 14*a*) is made up at the lowermost region of the liner 37 is screw threaded. A landing collar (not shown) is also provided on the liner 37 at a desired distance above the set shoe 38. A liner wiper plug 42 is secured to the end stop 151 of the running tool 5.

(2) The liner 37 is filled with drilling fluid.

Figure 13:
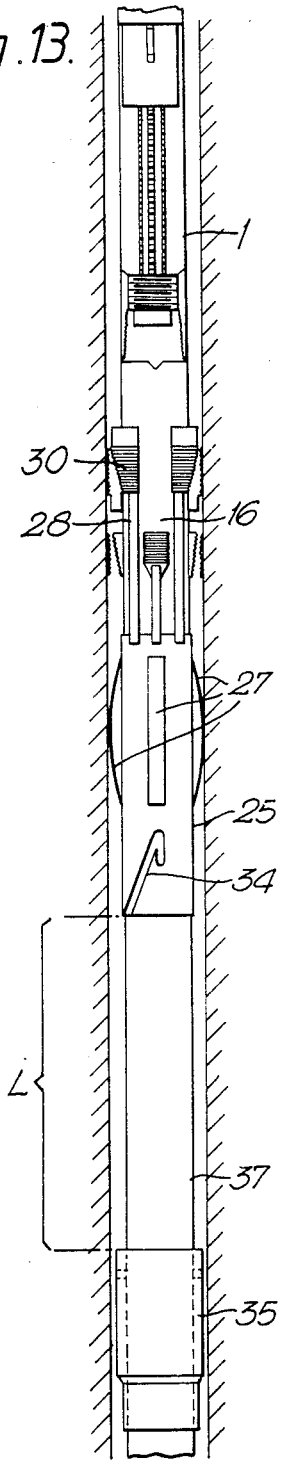
FIG. 13 is a view showing components remaining in the well after use of the setting assembly.

(3) The J-cage receptacle 35 is secured to liner 37 by Allen screws or threads at such a location on the liner 37 to determine the length L of "free" liner (FIG. 13).

(4) The cage 25 and the cone 16 are placed over the liner 37. The upper, screwthreaded end region of the liner 37 is then screwed into the threaded end portion 3 of the tie back receptacle 1 (see FIG. 10).

(5) A setting string 41 is inserted into the frustoconical portion 9 of the housing 10 of the running tool 5, and the nut 15 of the running tool 5 is screwed into the end portion 3 of the tie back receptable 1. The splines 11 of the running tool 5 engege the grooves 2 of the tie back receptacle 1.

(6) The assembly so formed (liner 37, cage 25, cone 16, J-cage receptacle 35, setting string 41, running tool 5 and tie back receptacle 1) is inserted into the well, the setting string 41 being filled with drilling fluid as required.

(7) The drilling fluid circulation is cut off and reestablished at a desired flow rate and pressure once the assembly has been inserted into the well.

(8) The liner 37 is inserted into the well to the desired depth. The correct position of the cage and cone assembly relative to the liner 37 is determined by cooperation of the lugs 36 of the J cage receptacle 35 with the J slots 34 of the cage 16.

(9) The liner 37 is withdrawn by about 12 m (40") and is rotated three turns to the right by turning the setting string 41. The liner 37 is then reinserted into the well until it starts to take its own weight on the cage and cone assembly.

Figure 11:
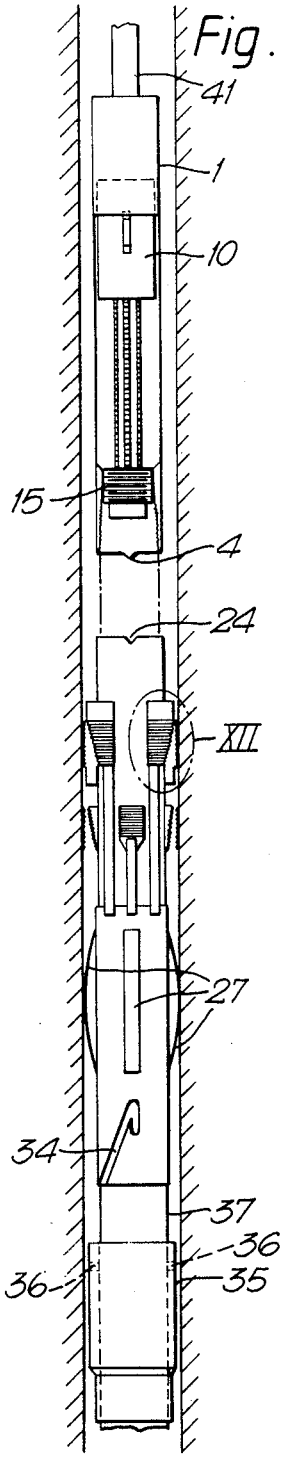
FIG. 11 is a diagrammatic view of the assembly with the hanger in the SET position.
Figure 12:
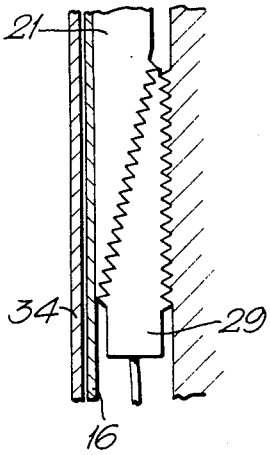
FIG. 12 is an enlarged view of the encircled portion XII of FIG 11.

(10) A setting force is then applied to the cone 16 of the cone and cage assembly by the tie back receptacle 1, the tongues 4 of which rest in the notches 24 of the cone. The setting force is applied up to preset value, e.g., 12,500 Kg, to urge the grips 21 of the cone 16 into engagement with the grips 29 of the cage 25 so that the latter are pressed outwardly against the wall of the casing string. The cage and cone assembly is now set (FIG. 11).

Figures 14A, 14B, 14C, 14D:
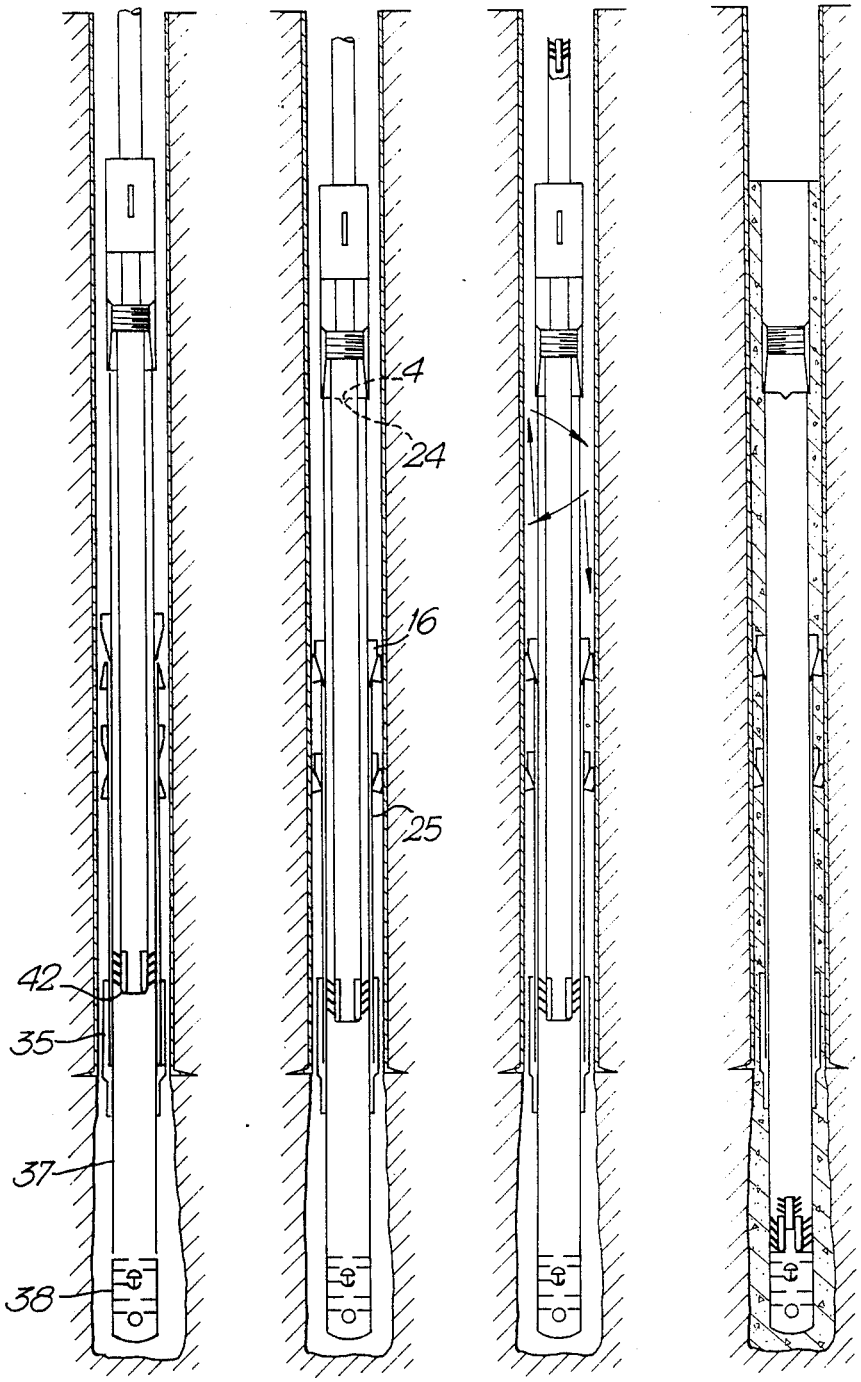
FIGS. 14*a* through *d* show steps in the setting process.

(11) Cement is pumped down the interior of the liner 37 to emerge from its lower region to fill the annular gap between the liner 37 and the wall of the well (FIG. 14*c*). During this step, the liner 37 can be reciprocated and rotated to aid circulation of the cement (as indicated by arrows R).

(12) A pump down plug 43 followed by drilling fluid is released into the setting string 41 to wipe the setting string 41 clean of cement so as to prevent contamination of drilling fluid and cement.

(13) The setting string 41 is displaced and the pumping rate of drilling fluid is slowed down until the pump down plug 43 reaches the liner wiper plug 42. As is known, the shearing of a pin in the liner wipe plug 42 by the pump down plug 43 results in an increase of pressure, e.g. 1000 psi, detectable by the operator. The combined plug assembly so formed is then used to wipe the liner 37 clean.

(14) Pumping of drilling fluid continues until the liner wiper plug 42 seats in the landing collar, indicated by further increase in pressure.

(15) Rotation and reciprocation of the liner 37 is stopped, and the liner 37 is inserted until its weight is taken by the setting tool and cone and cage assembly.

(16) The running tool 5 is now pushed inwardly into the setting tool 1, releasing the spring loaded splines 11 from the grooves 2 of the tie back receptacle 1.

(17) A predetermined weight, e.g. 5,000 kg, is applied to the cone and cage assembly by the tie back receptacle 1 and the setting string 41 is rotated to the right to release the running tool 5. The running tool 5 can be removed from the setting tool 1.

FIGS. 13 and **14*d*** show the components remaining in the well from the setting tool.

It will be apparent from the above that the cone and cage assembly is secured to the casing string by the flat notched faces 30 of the grips 29. The tube of the cone 16 is machined to have a sliding fit in relation to the liner 37. This enables the operator to reciprocate and rotate the liner 37 even when the cone and cage assembly is fixedly secured to the casing string (in the SET position). The grips 29 prevent the cone and cage assembly from moving during such reciprocation and rotation. This means that a positive indication of the correct SET position can be made prior to reciprocation and rotation for cementing. This ability to reciprocate or rotate after the hanger (cone and cage assembly) has been SET, but before the liner 37 is cemented into position, has not been possible prior to development of the apparatus described herein. This ability enables the liner 37 to be reciprocated and rotated, after its hanger position has been set, to enhance cement bonding of the liner 37 to the well wall. It also reduces costs incurred in later remedial work. In addition the cooperation of the J-cage receptacle 35 with the cage 25 enables the cone and cage assembly to be set into an accurate position.

I claim:

1. A liner setting assembly for use in setting a liner into a casing string, the casing string being secured in a borehole, the assembly comprising:

(a) a first component for slidably fitting over the liner to be set, the first component having outer peripheral walls, the first component having a first plurality of engaging devices disposed on the outer peripheral walls, the first plurality of engaging devices having engaging surfaces, said first component being arranged to make a sliding fit over said liner;

(b) a second component adapted to receive the first component, the second component having a second plurality of engaging devices, each engaging device of the second plurality having a first surface and a second surface, the first surface being configured to engage a corresponding first surface of one of the first plurality of engaging devices, the second surface being adapted to engage the casing string; and (c) means permitting reciprocal movement of said liner after the second component has been set and white said second component is maintained in said set condition.

2. The liner setting assembly of claim 1, wherein the engaging devices of the first component each comprise an oblique notched surface portion protruding from the outer peripheral wall of the first component.

3. The liner setting assembly of claim 2, wherein the first tubular component has a plurality of notches at the upper periphery thereof and the setting tool has a corresponding plurality of tongues arranged so as to allow the reversible abutment of said first tubular component with said setting tool.

4. The liner setting assembly of claim 1, wherein the engaging devices of the first component each comprise an oblique notched surface portion protruding from the outer peripheral wall of the first component.

5. The liner setting assembly of claim 1, wherein the second component comprises an elongated tubular portion for receiving the first component and from which extends a plurality of arms substantially parallel to the axis of the elongated portion, each arm carrying a respective one of the second plurality of engaging devices.

6. The liner setting assembly of claim 5, wherein the first and second surfaces of each of the engaging devices of the second component are oblique notched surfaces.

7. The liner setting assembly of claim 1, further comprising a receptacle adapted to be secured to the liner having at least one internally projecting lug and in which the second component is provided with an angled slot to cooperate with the lug to prevent premature setting of the liner.

8. A method of setting a liner into a casing string, the casing string being secured in a borehole, the method comprising:

(a) slidably fitting over the liner a first component and a second component, the first component having an outer peripheral wall, the first component having a first plurality of engaging devices disposed on the outer peripheral wall, the second component partially receiving the first component, the second component having a second plurality of engaging devices, each engaging device of the second plurality having a first surface and a second surface, the first surface engaging one of the first plurality of engaging devices;

(b) inserting the liner into the casing string, the liner having the first and second components fitted thereover;

(c) engaging the second surfaces of the engaging devices of the second plurality with the casing string at a preselected depth;

(d) introducing a bonding constituent into the borehole via the liner; and (e) reciprocating the liner after the second surfaces of the engaging devices have been engaged with the casing string to enhance bonding of the liner to the borehole.

9. The method of claim 8, further comprising:

(e) rotating the liner after the second surfaces of the engaging devices have been engaged with the casing string to enhance bonding of the liner to the borehole.

10. A liner setting assembly for use in setting a liner into a casing string being disposed in a borehole, the assembly comprising:

(a) a first component for slidably fitting over the liner to be set, the first component having outer peripheral walls, the first component having a first plurality of engaging devices disposed on the outer peripheral walls, the first plurality of engaging devices having engaging surfaces;

(b) a second component being adapted to receive the first component, the second component having a second plurality of engaging devices, each engaging device of the second plurality having a first surface and a second surface, the first surface being engageable with a corresponding first surface of the first plurality of engaging devices, the second surface being engageable with the casing string; and (c) means for permitting the liner to be reciprocatable within the borehole while the second component is set in the casing string.

* * * * *

UNITED STATES PATENT AND TRADEMARK OFFICE

CERTIFICATE OF CORRECTION

PATENT NO. : 4,942,924

DATED : July 24, 1990

INVENTOR(S) : Stewart M. Duncan

It is certified that error appears in the above-identified patent and that said Letters Patent is hereby corrected as shown below:

Column 5, lines 65-68, should be deleted to be replaced with

--A liner setting assembly as claimed in claim 1 further comprising a setting tool for setting the liner into the casing string.--

Signed and Sealed this

Twenty-third Day of November, 1993

*Attest:*

Bruce Lehman

BRUCE LEHMAN

*Attesting Officer*

*Commissioner of Patents and Trademarks*